US005431404A

United States Patent [19]

Kotecki

[11] Patent Number: 5,431,404

[45] Date of Patent: Jul. 11, 1995

[54] PRACTICE GOLF BALL DRIVER

[76] Inventor: Michael B. Kotecki, 3406 Mt. Garfield Rd., Fruitport, Mich. 49415

[21] Appl. No.: 281,175

[22] Filed: Jul. 27, 1994

[51] Int. Cl.[6] ..... A63B 69/36

[52] U.S. Cl. ..... 273/185 C; 242/387; 242/390.8; 273/200 R

[58] Field of Search ..... 273/185 C, 411, 413, 273/414, 200 R, 58 C; 242/54 R

[56] References Cited

U.S. PATENT DOCUMENTS

| | | | |
|---|---|---|---|
| 1,963,311 | 6/1934 | Olsen | 273/200 R |
| 2,051,751 | 8/1936 | Simon | 273/185 C |
| 3,735,934 | 5/1973 | Black | 273/200 C X |
| 3,826,439 | 7/1974 | Moon | 273/200 R X |
| 3,876,162 | 4/1975 | Chun et al. | 273/200 R |
| 4,095,787 | 6/1978 | Saferstein | 273/413 X |
| 4,139,197 | 2/1979 | Windall | 273/185 C |
| 4,240,592 | 12/1980 | Russo | 273/200 R X |
| 5,054,786 | 10/1991 | Solomon | 273/200 R |
| 5,121,923 | 6/1992 | D'Allura | 273/185 C |

FOREIGN PATENT DOCUMENTS

WO89/04699 6/1989 WIPO .

*Primary Examiner*—William H. Grieb
*Attorney, Agent, or Firm*—Richard C. Litman

[57] ABSTRACT

The present invention is a portable mechanism utilized to practice a golf swing. It includes a golf ball connected to a tethering line. When the golf ball is driven or otherwise projected a substantial distance, a spindle freely pays out the tethering line though a line guide. After the paying out of the tethered line has terminated, a battery operated motor rotates the spindle to permit for automatic retrieval of the golf ball. A swivel damper allows the golf ball to rotate relative to the tethering line, which eliminates the possibility of the tethering line twisting upon itself, and also assures that flight of the ball is in accordance with the manner in which it was struck. A housing, having open sides or entrances, allows for easy maintenance of the spindle and related components.

8 Claims, 2 Drawing Sheets

PRACTICE GOLF BALL DRIVER

BACKGROUND OF THE INVENTION

1. Field of the Invention

The present invention relates to a retrieving mechanism for a tethered golf ball. More specifically, the invention relates to a retrieving mechanism capable of automatically returning a propelled golf ball to a location proximate to the location where the golf ball was originally driven.

2. Description of the Prior Art

It is commonly known that the sport of golf can only be mastered after hours of practice. To facilitate such practice, there have been many inventions concerned with mechanisms enabling a golf enthusiast to repetitively simulate his or her golf swing. One invention of this type is disclosed in U.S. Pat. No. 5,121,923 issued to John D'Allura on Jun. 16, 1992. The mechanism of this invention includes a tethered golf ball attached to rotatable bearing. This bearing is affixed to an elongate horizontal arm, which, in turn, is connected to an elongate vertically extending arm. The distance between the golf ball and the bearing is fixed by a flexible cord, and after the ball is driven with a golf club, it travels circuitously around the bearing. The path of movement of the golf ball around the bearing permits the golf enthusiast to determine if the golf ball was either "sliced" or "hooked" when struck by the golf club.

In addition to mechanisms wherein a driven golf ball repetitively encircles a bearing, the prior art includes mechanisms wherein the driven golf ball travels a substantial distance, and then is either manually or automatically returned to a location proximate to its original position. One patent showing the manual returning of a driven golf ball is U.S. Pat. No. 4,139,197 issued to Owen D. Windall on Feb. 13, 1979. The mechanism of this invention includes a spindle and a housing located a spaced distance from the spindle. A line guide connects the spindle to the housing, and a line, having a golf ball tethered thereto, is slidably mounted to the line guide. When the tethered golf ball is driven, displacement of the line causes displacement of a movable indicator arm positioned within the housing. This indicator arm displays the distance through which the driven golf ball has traveled. To return the golf ball to a location proximate its original position, the spindle is manually wound using a handle extending from the top surface of the spindle.

A golfing mechanism wherein the driven golf ball is automatically returned to the golfing enthusiast is U.S. Pat. No. 1,963,311 issued to William Olsen on Jun. 19, 1934. This mechanism utilizes recoil forces of a spring to retract the driven golf ball to a location proximate its original, pre-driven location. A tethered golf ball is attached to a coiled spring, whose tension restrains the flight of the driven golf ball. After the golf ball travels a substantial distance, the tension forces of the spring slow the ball until it reaches an equilibrium state, and falls to the ground. The recoil forces of the spring then pull the ball back to its original, pre-driven position.

Other inventions utilizing a spring to effect the return of a driven golf ball are shown in U.S. Pat. No. 2,051,751 issued to Louis John Simon on Aug. 18, 1936, and International Application No. PCT/SE88/00492 of Thomas Viklund, published on Jun. 1, 1989. The Simon patent enables a golf enthusiast to simulate an entire round of golf. Included in this mechanism is a golf ball anchored to a cord that is wrapped around a drum. An indicator shows and records the distance of each stroke so that the cumulative progress of the game can be updated and stored. The Viklund application illustrates a mechanism having a line wrapped around a caspian. Attached to the end of this line is an elastic cord having a stop and a tethered golf ball attached thereto. A guide extends from the caspian and encircles the line. This guide prevents passage of the stop therethrough to eliminate the possibility that the elastic cord could become wound upon the caspian during recoil of the return spring.

Golfing mechanisms wherein the return of the driven golf ball is effectuated by a motor are disclosed in U.S. Pat. No. 3,826,439 issued to Paul G. Moon on Jul. 30, 1974, and U.S. Pat. No. 4,240,592 issued to Andrew N. Russo on Dec. 23, 1980. The Moon patent illustrates a compact golf ball retriever having a winding spool, a line with a tethered ball wrapped around the spool, and a motor for winding the spool, all stored within an enclosed housing. A small hole in the housing allows the golf ball to be positioned outside the housing so that it may be appropriately driven with a golf club. A solenoid powered ball receiving member is located within the housing, allowing the golf ball to be stored within the housing when the mechanism is not utilized.

The Russo patent discloses a golf ball retrieving apparatus having a hoop-like line guide positioned in a spaced relationship relative to a spool. A golf ball is attached to a line wrapped around the spool. The line is positioned to extend through the hoop, so that when the golf ball is driven, the line is payed out concentrically through the hoop. As the hoop contains minimal line-engaging surface, the flight of the driven golf ball is not substantially influenced by the line attached thereto.

None of the above inventions and patents, taken either singly or in combination, is seen to describe the instant invention as claimed.

SUMMARY OF THE INVENTION

The present invention is a mechanism utilized to practice a golf swing. It includes a golf ball connected to a tethering line. When the golf ball is driven or otherwise projected a substantial distance, a spindle freely pays out the tethering line though a line guide. After the paying out of the tethered line has terminated, a battery operated motor rotates the spindle to permit automatic retrieval of the golf ball. During the flight and subsequent retrieval of the golf ball, a swivel damper allows the golf ball to rotate relative to the tethering line. This eliminates the possibility of the tethering line twisting upon itself, and also assures that the flight of the golf ball will be substantially in accordance with the manner in which the golf ball was struck.

The spindle and the battery operated motor are stored within a housing, configured to have a pair of open sides usable as entrances for accessing the equipment therein. The front panel of this housing includes an opening substantially aligned with the line guide. This opening is significantly larger than the line guide to minimize the likelihood of the tethering line engaging the front panel. The dimensions of the line guide are such that the swivel damper cannot pass therethrough. This prevents the swivel damper from winding upon the spindle.

Accordingly, it is a principal object of the invention to provide a novel golf training apparatus capable of automatically retrieving a driven golf ball.

It is another object of the invention to provide a novel golf training apparatus utilizing a tethering line that is prevented from entangling with itself.

It is a further object of the invention to provide a novel golf training apparatus that is easy to manufacture and is portable.

Still another object of the invention is to provide a novel golf training apparatus that allows for easy access to its component parts.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
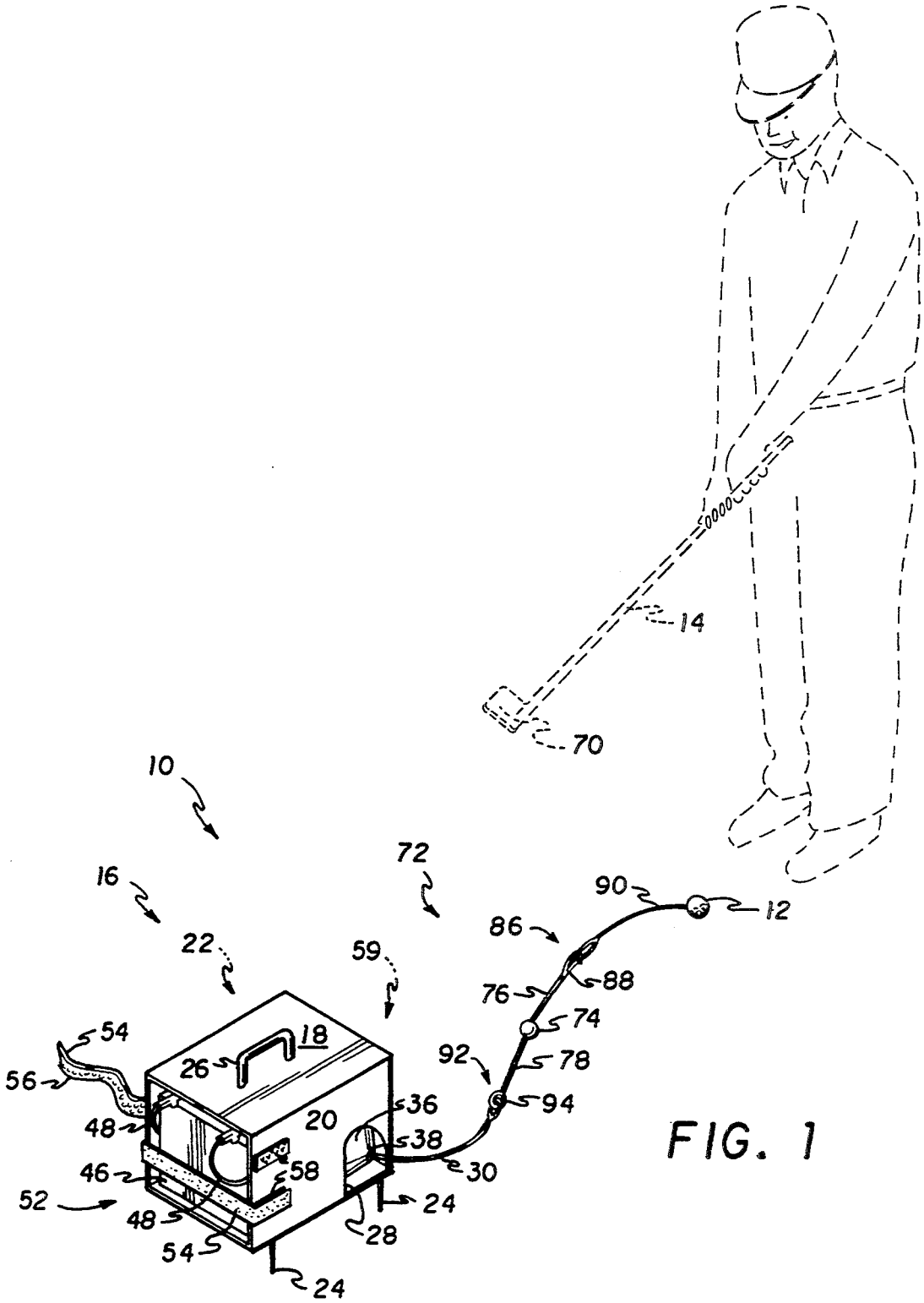
FIG. 1 is an environmental, perspective view of the apparatus of the invention.
Figure 2:
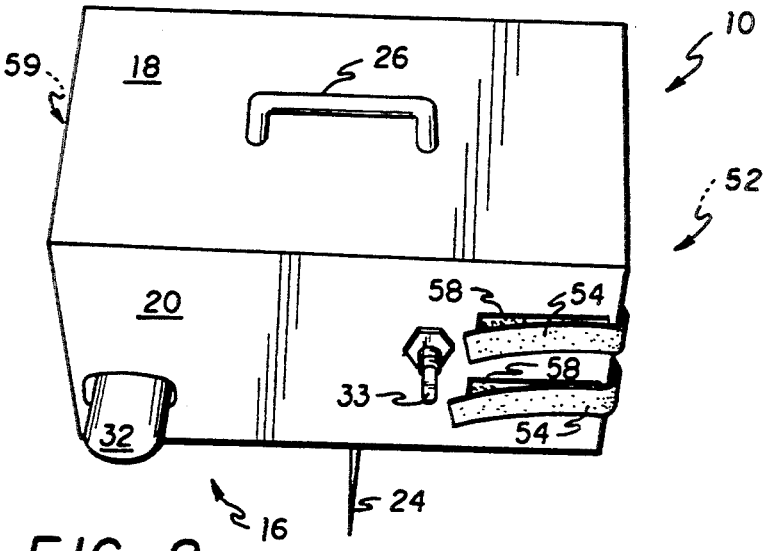
FIG. 2 is an enlarged, perspective view of the apparatus of FIG. 1.

Referring to FIGS. 1 and 2, the present invention is a portable mechanism 10 for retrieving a tethered golf ball 12, or the like. A user of mechanism 10 swings the golf club 14 to contact golf ball 12 and drive it a substantial distance from the housing 16. After the flight of driven golf ball 12 has terminated, and golf ball 12 has come to rest, mechanism 10 returns golf ball 12 to the user, so that it can again be struck by golf club 14.

Included in housing 16 is a top panel 18, a bottom panel (not shown), a front panel 20, and a back panel 22. The bottom panel includes a plurality of spikes 24 for temporarily securing housing 16 to the ground, and top panel 18 includes a handle 26 for transporting mechanism 10. An opening 28 formed within front panel 20 allows for passage of tethering line 30. A pair of controls 32,33 for regulating the paying out and taking up of line 30 are affixed to back panel 22. The positioning of these controls 32,33 on back panel 22 assures that they do not impede tethering line 30 as it is expelled from or pulled into opening 28.

Figure 3:
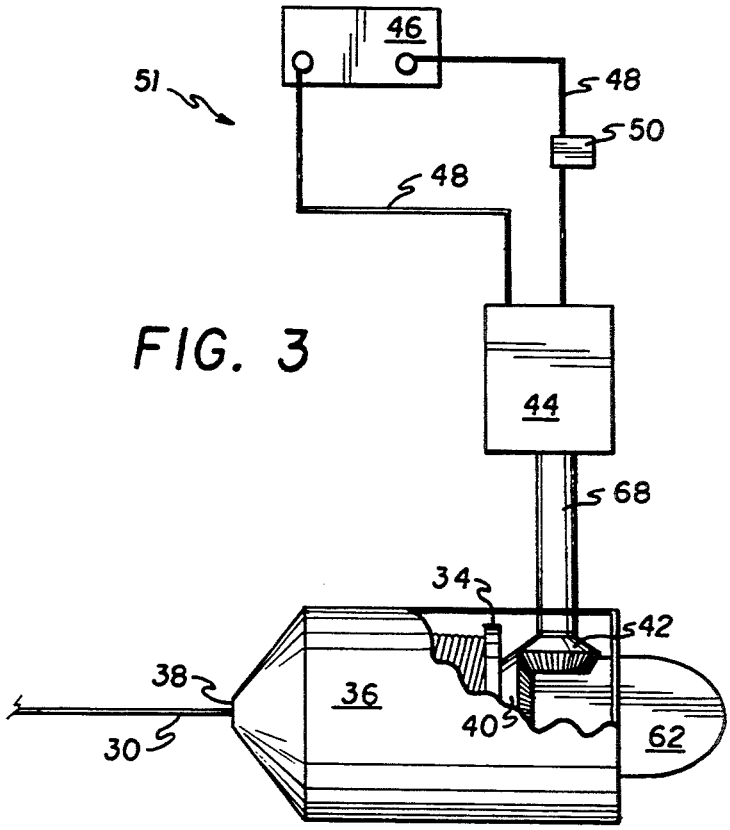
FIG. 3 is a schematic, top plan view of the components of the apparatus of FIG. 1.

Stored within housing 16 are the components shown in FIG. 3. These components include a spindle 34 having a substantial length of tethering line 30 wrapped thereupon. An encasement 36 surrounds spindle 34, and it includes an aperture or line guide 38, through which line 30 must pass as it is payed out or reeled in. Attached to spindle 34 is a gear 40 configured for mating with a drive gear 42. This drive gear 42 is driven by a motor 44 connected to a battery 46 by electrical wires 48. A switch 50 attached to control 33, closes the circuit 51 when it is desired to take up tethering line 30 after golf ball 12 has been displaced a substantial distance from housing 16.

As illustrated in FIG. 1, side 52 of housing 16 is substantially uncovered and acts as an entrance for accessing the components therein. A pair of straps 54 secure battery 46 within housing 16, in case mechanism 10 is dropped or otherwise mishandled. These straps 54 are attached to back panel 22, and are fabricated from hook and loop material 56 capable of securing to corresponding hook and loop material 58 affixed to both front panel 20 and back panel 22. Although not shown, the side 59 of housing 16 is left uncovered so that it may also be utilized as an entrance for accessing the components within housing 16.

Prior to driving golf ball 12, the user depresses control pedal 32, shown in FIG. 2, to place spindle 34 in a mode wherein it freely pays out tethering line 30. Pedal 32 is pivotally secured to housing 16, and it is affixed to a lever 62, shown in FIG. 3. Depression of pedal 32 causes lever 62 to push against gear 40, and break the contact between gear 40 and gear 42. In this mode, spindle 34 is capable of rotating freely, and golf ball 12 can be driven as desired. To facilitate placement of spindle 34 into its freely rotating mode, pedal 32 is substantially cup shaped so that the user can maneuver the club head 70 to push against pedal 32.

During flight of golf ball 12, tethering line 30 passes through opening 28. As illustrated in FIG. 1, encasement 36 is positioned within housing 16 so that line guide 38 is substantially aligned with opening 28. To prevent tethering line 30 from contacting housing 16, the user must propel golf ball 12 so that the trajectory of ball 12 is generally perpendicular to the face of front panel 20. If the user swings golf club 14 from his right side to his left side, he should position golf ball 12 between himself and side or entrance 59.

Alternatively, if the user swings golf club 12 from his left side to his right side, he should position golf ball 12 between himself and side or entrance 52. To eliminate damage of tethering line 30 due to contact with front panel 20, opening 28 is substantially larger than line guide 38. Therefore, the driven golf ball 12 can be either "hooked" or "sliced", without tethering line 30 becoming damaged by contacting housing 16.

After the flight of the driven golf ball 12 has ended and spindle 34 is no longer paying out tethering line 30, mechanism 10 can be operated to return golf ball 12 to a location proximate housing 16. Before the drive shaft 68 can rotate spindle 34, gear 40 must be positioned to engage gear 42, as shown in FIG. 3.

This can be accomplished by utilizing club head 70 to manually lift pedal 32, or, optionally, lever 62 can be conventionally connected to circuit 51, so that closure of circuit 51 automatically causes gear 40 to engage gear 42. After the gears 40,42 have been positioned appropriately, motorized rotation of drive shaft 68 causes spindle 34 to rotate in a direction that will take up tethering line 30, thus returning golf ball 12 to a location proximate housing 16. As mentioned previously, switch 33, which controls the closure of circuit 51, is located on back panel 22 of housing 16.

A tensioning device may be utilized to alter the rotational strength of spindle 34 when taking up tethering line 30. This allows the user to adjust the return of golf ball 12 to a speed and strength appropriate for any given environment. If the return of golf ball 12 is hindered by obstacles such as tall grass, the tensioning device would be adjusted to not interfere with the rotation of spindle 34. Alternatively, if the return of golf ball 12 is not obstructed by tall grass or other obstacles, the tensioning device would be adjusted to partially impede the rotation of spindle 34. Conventional tensioning devices suitable for the present invention are found on various fishing reels, such as the 1 Classic fishing reel manufactured by Zepco. Accordingly, in one preferred embodiment of the invention, such a fishing reel with an integral tensioning device can be utilized as spindle 34. Since such reels with integral tensioning devices are well known per se, discussion of further details of construction are not necessary.

A swivel damper 72 is positioned between golf ball 12 and tethering line 30. This swivel damper 72 permits golf ball 12 to rotate relative to tethering line 30, which is important for two reasons. First, the rotation of golf ball 12 is prevented from causing tethering line 30 to twist and wind upon itself, and thus minimizes the possibility of entanglement. Second, rotation of golf ball 12 is not substantially hindered by tethering line 30, thus assuring that the trajectory of ball 12 assumes characteristics of an un-tethered ball.

Figure 4:
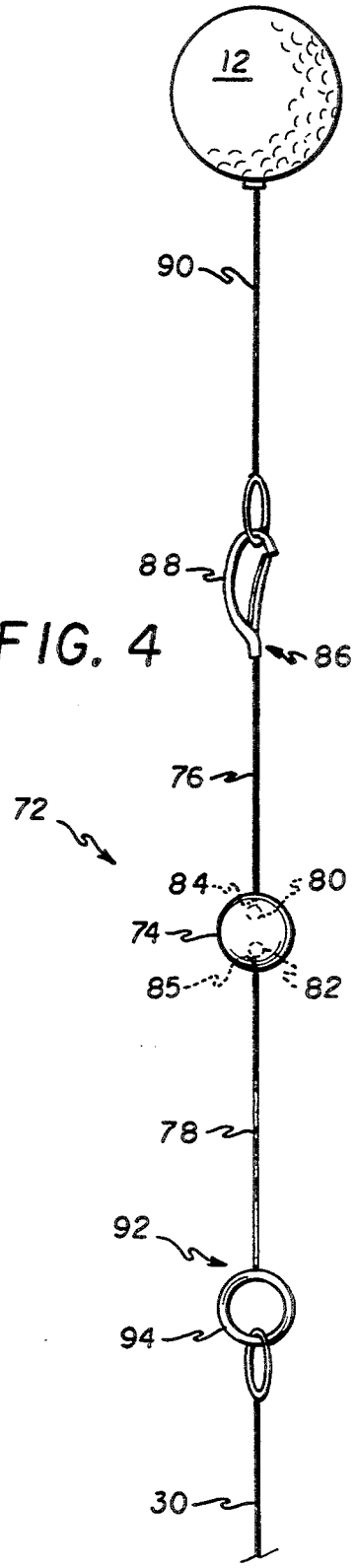
FIG. 4 is an enlarged, top plan detail view of the swivel damper of the apparatus of FIG. 1.

Essential to swivel damper 72 is a central casing 74, shown most clearly in FIG. 4. Extending from this central casing 74 are a first lead line 76 and a second lead line 78, both of which include respective knots 80,82, disposed within central casing 74. The outer diameters of these knots 80,82 are greater than the diameter of the bores 84,85 through which the first and second lead lines 76,78 extend, respectively. By this arrangement, the first and second lead lines 76,78 are affixed to central casing 74, but are permitted to rotate therein.

The free end 86 of first lead line 76 is connected to a clasp 88, upon which the cord 90 of tethered golf ball 12 can be secured. This clasp 88 allows for quick replacement of golf ball 12, should it become broken, or otherwise worn. The free end 92 of second lead line 78 includes a ring 94, to which the tethering line 30 can be secured. The dimensions of this ring 94 are such that it cannot pass through line guide 38, thus preventing swivel damper 72 from winding upon spindle 34. Keeping swivel damper 72 away from spindle 34 minimizes the possibility that tethering line 30 can become entangled upon swivel damper 72. Although not shown, free end 92 could include a clasp, similar to clasp 88, which would permit for quick replacement of swivel damper 72.

It is to be understood that the present invention is not limited to the sole embodiment described above, but encompasses any and all embodiments within the scope of the following claims.

I claim:

1. A golf training apparatus comprising:

(A) a projectile having a cord extending therefrom (B) a tethering line attached to said projectile;

(C) a spindle capable of paying out and taking up said tethering line;

(D) a swivel damper comprising:

a central casing a first lead line connecting said central casing to said projectile, said first lead line being rotatable with respect to said central casing:

a second lead line connecting said central casing to said tethering line, said second lead line being rotatable with respect to said central casing;

(E) a clasp attached to said first lead line, said clasp removably connecting said first lead line to said cord; and (F) a tensioning device which alters said spindle's strength when taking up said tethering line.

2. The golf training apparatus according to claim 1, wherein said spindle includes a line guide dimensioned and configured to prevent said swivel damper from passing thereby.

3. The golf training apparatus according to claim 1, further comprising a battery operated motor attached to said spindle, said battery operated motor for actuating the taking up of said tethered line.

4. The golf training apparatus according to claim 3, further comprising a housing partially surrounding said spindle and said battery operated motor, said housing defining a pair of entrances.

5. The golf training apparatus according to claim 4, wherein said housing further comprises:

a front panel;

a back panel; and at least one strap extending from said front panel to said back panel, said at least one strap covering a portion of one entrance of said pair of entrances.

6. The golf training apparatus according to claim 5, wherein said front panel is configured to include an opening therein dimensioned and configured to permit passage of said tethering line from said spindle, said opening being significantly larger than said line guide.

7. A golf training apparatus comprising:

(A) a projectile having a cord extending therefrom;

(B) a tethering line attached to said projectile;

(C) a spindle capable of paying out and taking up said tethering line, said spindle having a line guide attached thereto;

(D) a battery operated motor attached to said spindle, said battery operated motor for actuating the taking up of said tethered line.

(E) a swivel damper dimensioned and configured to be incapable of passing by said line guide, said swivel damper comprising:

a central casing;

a first lead line connecting said central casing to said projectile, said first lead line being rotatable with respect to said central casing;

a second lead line connecting said central casing to said tethering line, said second lead line being rotatable with respect to said central casing;

(F) a clasp attached to said first lead line, said clasp for removably connecting said first lead line to said cord; and (G) a housing partially surrounding said spindle and said battery operated motor, said housing defining a pair of entrances, said housing having a front panel, a back panel, and at least one strap extending from said front panel to said back panel, said at least one strap covering a portion of one entrance of said pair of entrances, said front panel being configured to include an opening therein for passage of said tethering line from said spindle, said opening being significantly larger than said line guide.

8. The golf training apparatus according to claim 7, further comprising a tensioning device.

* * * * *